US006543090B2

(12) United States Patent
Muneta

(10) Patent No.: US 6,543,090 B2
(45) Date of Patent: Apr. 8, 2003

(54) AUTOMOBILE HANDLE DEVICE

(75) Inventor: Tuyoshi Muneta, Aki-gun (JP)

(73) Assignee: U-Shin Ltd., Tokyo (JP)

( * ) Notice: Subject to any disclaimer, the term of this patent is extended or adjusted under 35 U.S.C. 154(b) by 0 days.

(21) Appl. No.: 09/798,956

(22) Filed: Mar. 6, 2001

(65) Prior Publication Data

US 2002/0073510 A1 Jun. 20, 2002

(30) Foreign Application Priority Data

Dec. 14, 2000 (JP) ..... 2000-380197

(51) Int. Cl.[7] ..... E05B 3/00
(52) U.S. Cl. ..... 16/412; 292/336.3
(58) Field of Search ..... 16/412, 114.1, 16/406, 408, 409, 410, 413, 436, 444; 292/336.3; 49/460

(56) References Cited

U.S. PATENT DOCUMENTS 4,883,296 A * 11/1989 Laurie ..... 292/336.3
5,791,703 A * 8/1998 Kritzler et al. ..... 292/336.3
6,059,329 A * 5/2000 Spitzley ..... 16/412
6,363,577 B1 * 4/2002 Spitzley ..... 16/438
6,378,921 B1 * 4/2002 Deischl et al. ..... 292/336.3
6,401,302 B1 * 6/2002 Josserand et al. ..... 16/444
6,415,636 B1 * 7/2002 Fukumoto et al. ..... 292/336.3

* cited by examiner

*Primary Examiner*—Anthony Knight
*Assistant Examiner*—Doug Hutton
(74) *Attorney, Agent, or Firm*—Wenderoth, Lind & Ponack, L.L.P.

(57) ABSTRACT

An automobile handle device comprises a handle member 2 having an arm section 3 provided with a pivot shaft insert groove 4 on the edge thereof, and a base member 30 for fixing the handle member 2 on an automobile door panel 1, wherein a cover member 37 is provided which covers the base member 30 and which has a first wall section 43 for restricting the movement of the handle member 2 in a certain direction within a rotational range of the handle member 2. This prevents a base member 30 from being detached from the handle member 2 and improves operability in the assembling process of the automobile door panel 1.

5 Claims, 7 Drawing Sheets

AUTOMOBILE HANDLE DEVICE

BACKGROUND OF THE INVENTION

The present invention relates to a handle device for an automobile door.

As a prior art, there has been known an automobile handle device in which a handle member is rotated in a horizontal direction to open an automobile door.

As shown in FIG. 6, the handle device is made up of a handle member 2, a first base member 6 for fixing the handle member 2 on an automobile door panel 1, and a second base member 12.

On one end of the handle member 2, there is protrusively provided an arm section 3 having an approximate L shape and which is mounted on the first base member 6. The arm section 3 has a pivot shaft insert groove 4 provided on the top thereof. The pivot shaft insert groove 4 is formed to have an approximate U shape with a unilateral opening section 4*a* for improving operability in the assembling process. On the end of the handle member 2 opposite the arm section 3, there is protrusively provided a projected section 5 having an approximately lateral concave shape and which is mounted on the second base member 12.

The first base member 6 is to be installed in an edge portion of the handle member 2 on the side of the arm section 3. As shown in FIG. 7, the first base member 6 has a fixed board section 7 disposed along the door panel 1. The fixed board section 7 has an arm section insert hole 8 for inserting the arm section 3 of the handle member 2. On the upper surface of the fixed board section 7, there is provided a fixed section 9 to be positioned and fixed on the door panel 1, while on the lower surface of the fixed board section 7, there is provided a pair of frame board sections 10 extended from the edge of the arm section insert hole 8. These frame board sections 10 are disposed parallel to rotative direction of the arm section 3 in the handle member 2, and their top edges are integrally coupled by a coupling section 10*a*. On the top edge side of the frame board section 10, there is disposed a pivot shaft 11 across the frame board sections 10 for rotatably supporting the handle member 2 through the arm section 3.

The second base member 12 is to be installed in an edge portion of the handle member 2 on the side of the projected section 5. As shown in FIGS. 8, 9A, and 9B, the second base member 12 has a fixed base section 13 disposed along the door panel 1. The fixed base section 13 has a concave section 14 that matches with the shape of the edge portion of the handle member 2. In this concave section 14, there is provided an insert hole 15 for inserting the projected section 5. Below the insert hole 15, there is placed a lever 16 in a rotatable manner. The lever 16 is pressed downward in FIG. 8 by a spring 20. The fixed base section 13 also has a fixed section 17 to be positioned and fixed on the door panel 1, and a key cylinder mounting section 19 for mounting a key cylinder 18.

In order to mount the handle member 2 on the automobile door panel 1 by using the first base member 6 and the second base member 12, first the arm section 3 of the handle member 2 is inserted into the arm section insert hole 8 of the first base member 6 so that the pivot shaft 11 is fit into the pivot shaft insert groove 4. The projected section 5 of the handle member 2 is inserted into the insert hole 15 of the second base member 12, and after the lever 16 is hooked on the projected section 5 by rotating the lever 16, the lever 16 is rotatably supported together with the spring 20 by a pivot shaft. Then, a fastening section of the spring 20 is fastened to the lever 16, so that the projected section 5 is urged downward in FIGS. 6, 9A and 9B by the lever 16 subjected to restorative force of the spring 20.

In this way, the handle member 2 equipped with the first base member 6 and the second base member 12 is disposed on a mounting section 1*a* of the door panel 1, where the handle member 2 is fixed on the door panel 1 through the fixed sections 9 and 17 of the base members 6 and 12.

In this mounted state, the movement of the handle member 2 on the right side in FIG. 6 is restricted by the second base member 12. In addition, the lever 16 pressed downward by the spring 20 restricts the vertical movement within a certain extent. This prevents the handle member 2 from departing from the first base member 6 and the second base member 12.

However, in the above-stated automobile handle device, the first base member 6 and the handle member 2 are kept in the mounted state only by the engagement of the pivot shaft 11 in the pivot shaft insert groove 4, so that taking the handle member 2 in hand during mounting operation puts the first base member 6 in a freely rotatable state. Consequently, in the process of mounting the handle member 2 equipped with the first base member 6 and the second base member 12 on the door panel 1, if an X-directional force, shown in FIG. 10, opposite to the direction of the opening section 4*a* of the pivot shaft insert groove 4 is applied to the handle member 2, or if a Y-directional force, shown in FIG. 10, is applied to the first base member 6, the first base member 6 and the handle member 2 are detached from each other by a release of engagement between the pivot shaft 11 and the pivot shaft insert groove 4.

SUMMARY OF THE INVENTION

Accordingly, it is an object of the present invention to provide an automobile handle device which prevents detachment of a base member for fixing a handle member on a door panel and enables to improve operability in the assembling process.

In order to accomplish the above object, an automobile handle device of the present invention comprises: a handle member having an arm section protrusively provided on one end thereof and a pivot shaft insert groove with an opening section on an edge of the arm section; a base member for fixing the handle member on an automobile door panel, made up of a fixed base board section to be fixed on the door panel, an arm section insert hole formed on the fixed base board section for inserting the arm section of the handle member, a pair of frame board sections protrusively provided in parallel from an edge of the arm section insert hole, and a pivot shaft provided across the frame board sections and received in the pivot shaft insert groove to rotatably support the handle member, wherein a cover member is provided which covers the base member and which has a first wall section for restricting the movement of the handle member in such manner that the pivot shaft does not depart from the pivot shaft insert groove within a rotational range of the handle member.

According to the above automobile handle device, the cover member has a first wall section for restricting the movement of the handle member in such manner that the pivot shaft does not depart from the pivot shaft insert groove of the arm section, which prevents detachment of the base member from the handle member.

In the automobile handle device of the invention, it is preferable to provide a step section on a pair of the frame board sections of the base member on the side of the opening section of the handle member, and to provide the cover member with a second wall section to be engaged with the step section. This ensures prevention of detachment of the cover member from the base member.

It is also preferable that an edge of the arm section insert hole of the base member and the first wall section of the cover member constitute a restricting section for restricting a rotational range of the handle member.

Alternatively, it is preferable that the first wall section and the second wall section of the cover member constitute a restricting section for restricting a rotational range of the handle member.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
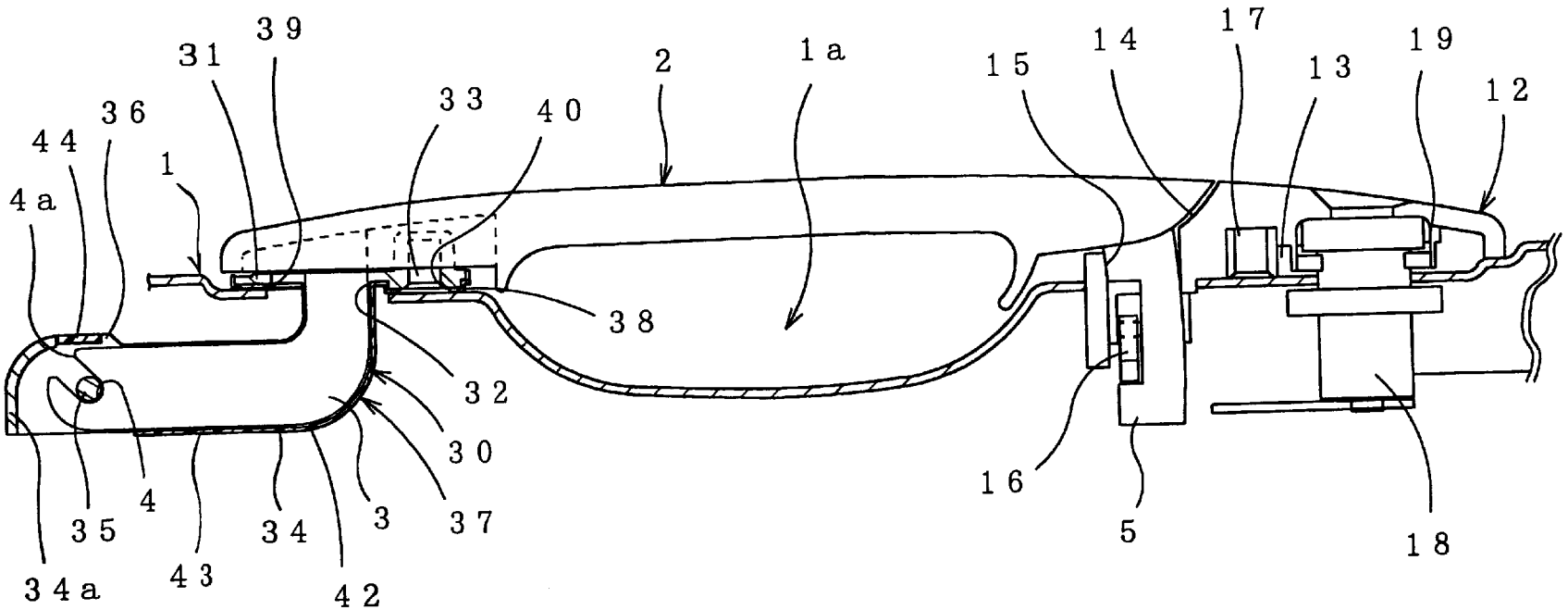
FIG. 1 is a cross sectional view showing an automobile handle device according to a first embodiment of the present invention.

FIG. 1 shows an automobile handle device in a first embodiment of the present invention. The handle device is made up of a handle member 2, a first base member 30 and a second base member 12 for fixing the handle member 2 on an automobile door panel 1, and a cover member 37 to be mounted on the first base member 30. It is noted that the door panel 1, the handle member 2 and the second base member 12 are the same as those in the prior art described above, so that the same reference numerals are imparted to the same members or elements and detailed description about them will be omitted.

Figure 2:
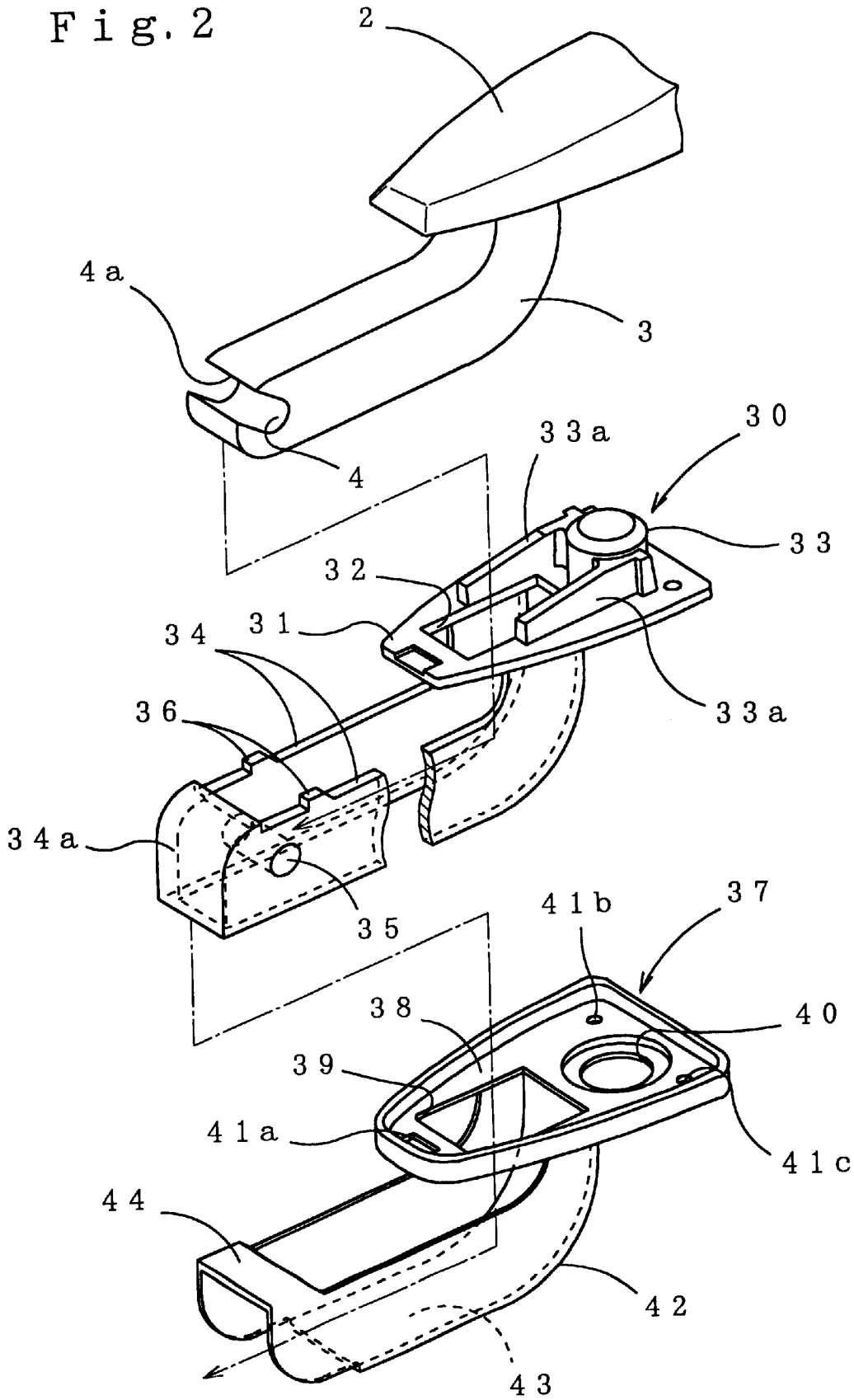
FIG. 2 is an exploded perspective view of a handle member, a first base member, and a cover member.

The first base member 30 is approximately identical to the first base member 6 in the prior art. As shown in FIG. 2, the first base member 30 has a fixed base board section 31 disposed along the door panel 1. The fixed base board section 31 has an arm section insert hole 32 for inserting the arm section 3 of the handle member 2. On the upper surface of the fixed base board section 31, there is provided a fixed section 33 to be positioned and fixed on the door panel 1. The fixed section 33 has a supporting frame 33*a* extended along both sides of the arm section insert hole 32. On the lower surface of the fixed base board section 31, there are provided a pair of frame board sections 34 on the edge of the arm section insert hole 32. These frame board sections 34 are provided parallel to rotative direction of the arm section 3 of the handle member 2, and their top edges are integrally coupled by a coupling section 34*a*. The upper corner of the coupling section 34*a* forms a chamfered curve. On the top edge side of the frame board sections 34, there is disposed a pivot shaft 35 across the frame board sections 34 for rotatably supporting the handle member 2. In addition, on the upper edges(in FIG. 2) of the frame board sections 34 located on the side of the opening section 4*a* of the handle member 2, there are provided step sections 36 upwardly projected with a specified space from the coupling section 34*a*.

The cover member 37 is mainly made up of a base section 38 covering the lower surface and outer peripheral edge of the fixed base board 31 of the first base member 30, and a cover section 42 protruded from the lower surface of the base section 38. For example, the base section 38 and the cover section 42 are integrally molded with resin.

The base section 38 has a first insert hole 39 identical to the arm section insert hole 32 in the first base member 30 provided at the position corresponding to the arm section insert hole 32. Also at the position on the base section 38 corresponding to the fixed section 33, there is provided a second insert hole 40 for inserting a fixed pivot shaft (not illustrated) provided on the door panel 1. It is noted that reference numerals 41*a*, 41*b*, and 41*c* in FIG. 2 denote fixing holes used to fix the cover member 37 to the first base member 30.

Figure 3:
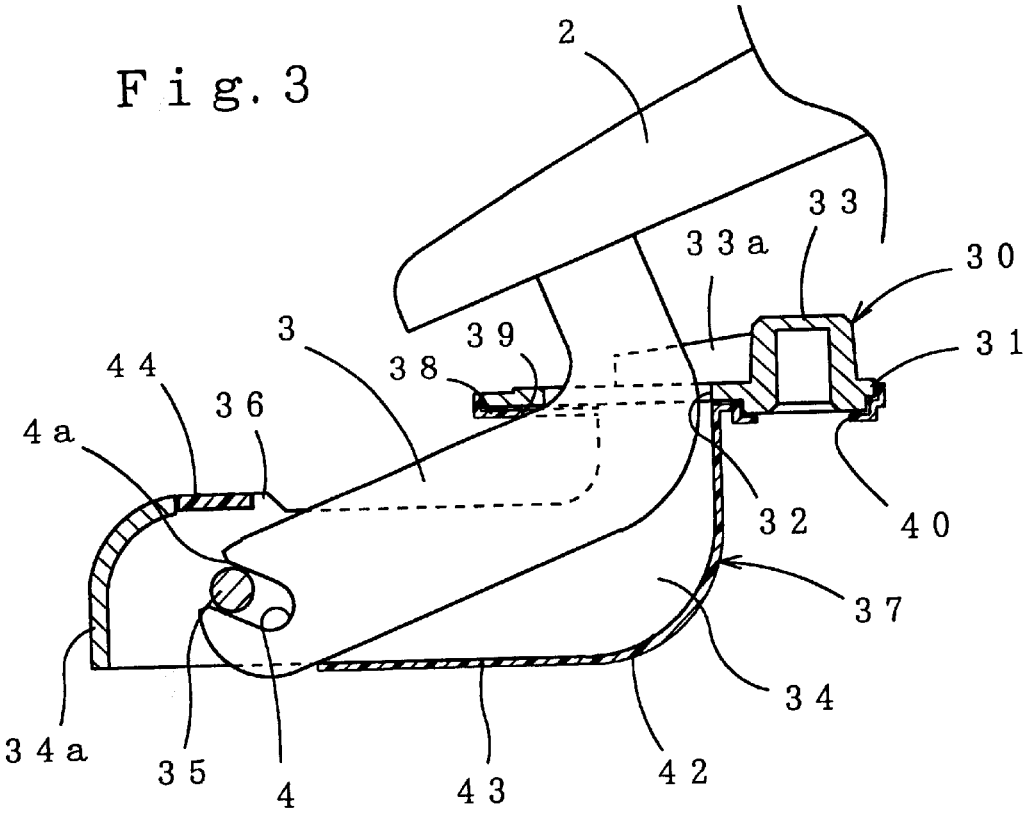
FIG. 3 is a cross sectional view showing each member of FIG. 2 assembled.

The cover section 42 having a U-shaped cross section is projected in an approximate L shape from the edge of the first insert hole 39. The cover section 42 has an opening on the upper surface, and the bottom section thereof constitutes a first wall section 43 which restricts the movement in the direction opposite to the opening section 4*a* of the axis insert hole 4 (i.e., which restricts the movement of the handle member 2 in such manner that the axis 35 does not depart from the axis insert groove 4) within a rotational range of the handle member 2. The first wall section 43, as shown in FIG. 3, has a specified length so as to constitute a restricting section together with the edge of the arm section insert hole 32 in the first base member 30 for restricting the rotational range of the handle member 2. The upper end of the cover section 42 is linked by a second wall section 44. The second wall section 44 is configured to have a width appropriate for being inserted and engaged between the coupling section 34*a* and the step sections 36 of the first base member 30.

Description will now be given of the assembly of the automobile handle device.

For example in the same way as the prior art, first the arm section 3 of the handle member 2 is inserted into the arm section insert hole 32 of the first base member 30. Then, the pivot shaft 35 of the first base member 30 is received into the pivot shaft insert groove 4 provided at the top edge of the arm section 3 through the opening section 4*a* thereof to rotatably support the handle member 2 against the first base member 30.

The projected section 5 of the handle member 2 is inserted into the insert hole 15 of the second base member 12. After the lever 16 is hooked on the projected section 5 having an approximately laterally concave shape by rotating the lever 16, the lever 16 is rotatably supported together with the spring 20 by a pivot shaft. Then, a fastening section of the spring 20 is fastened to the lever 16.

Figure 4:
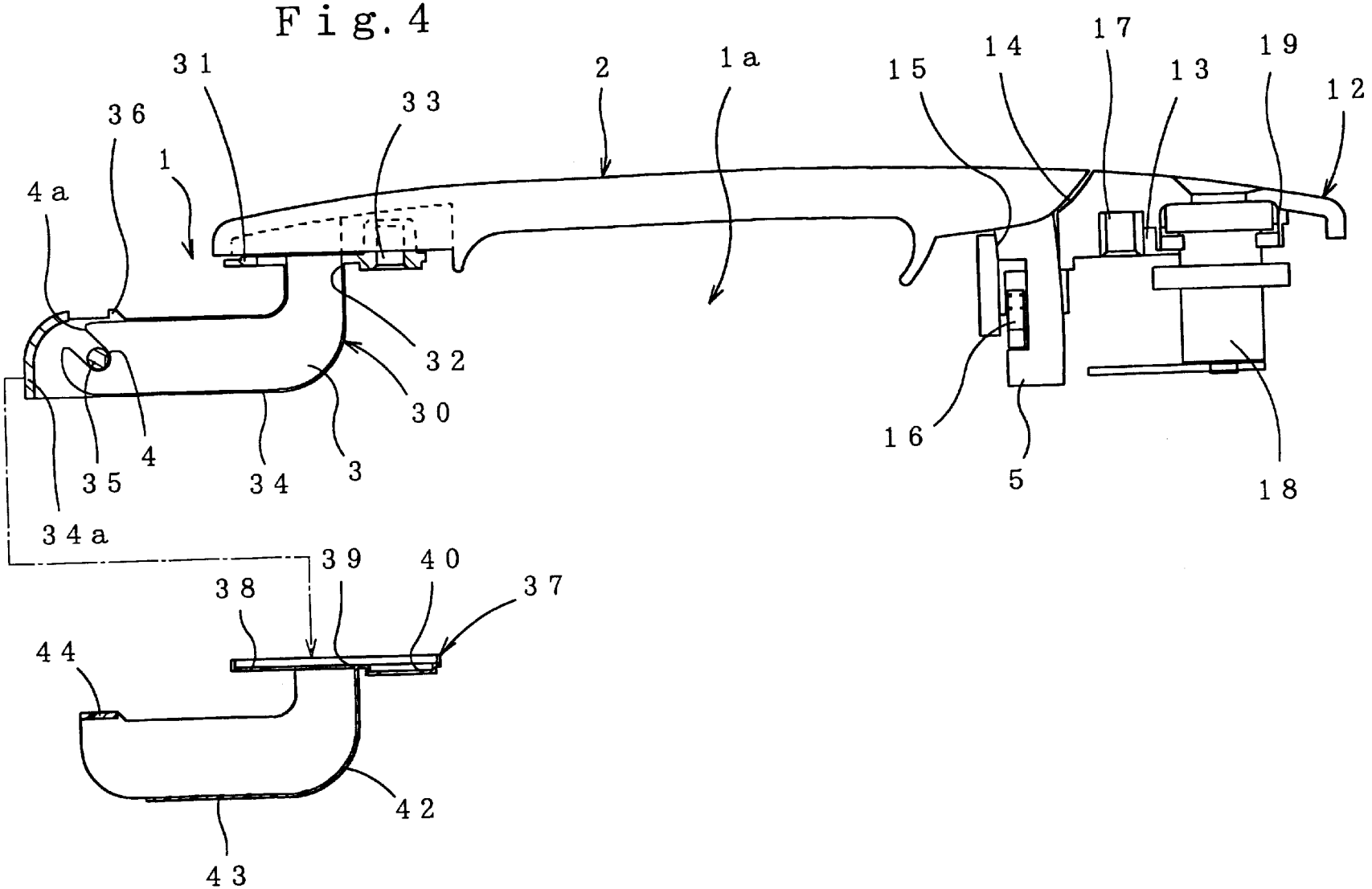
FIG. 4 is a cross sectional view showing the state before the cover member is assembled.
Figure 6:
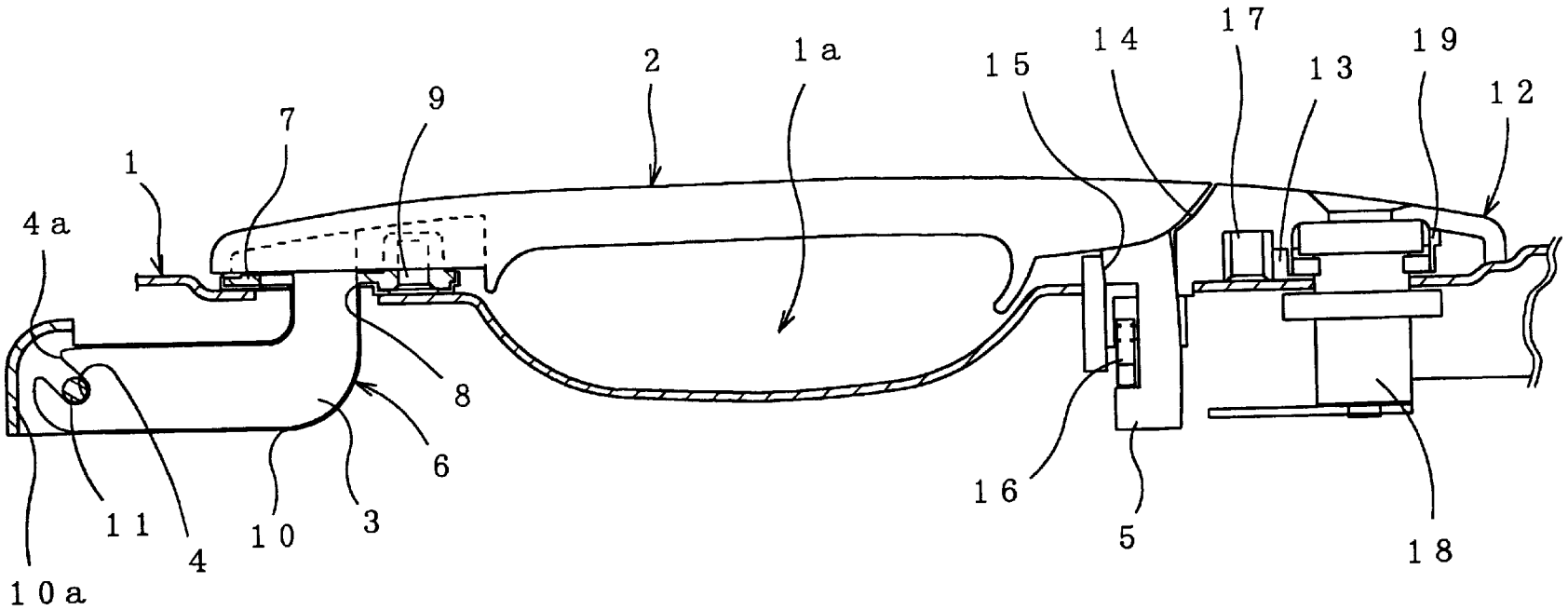
Fig. 6 PRIOR ART
FIG. 6 is a cross sectional view showing a prior art automobile handle device.
Figure 7:
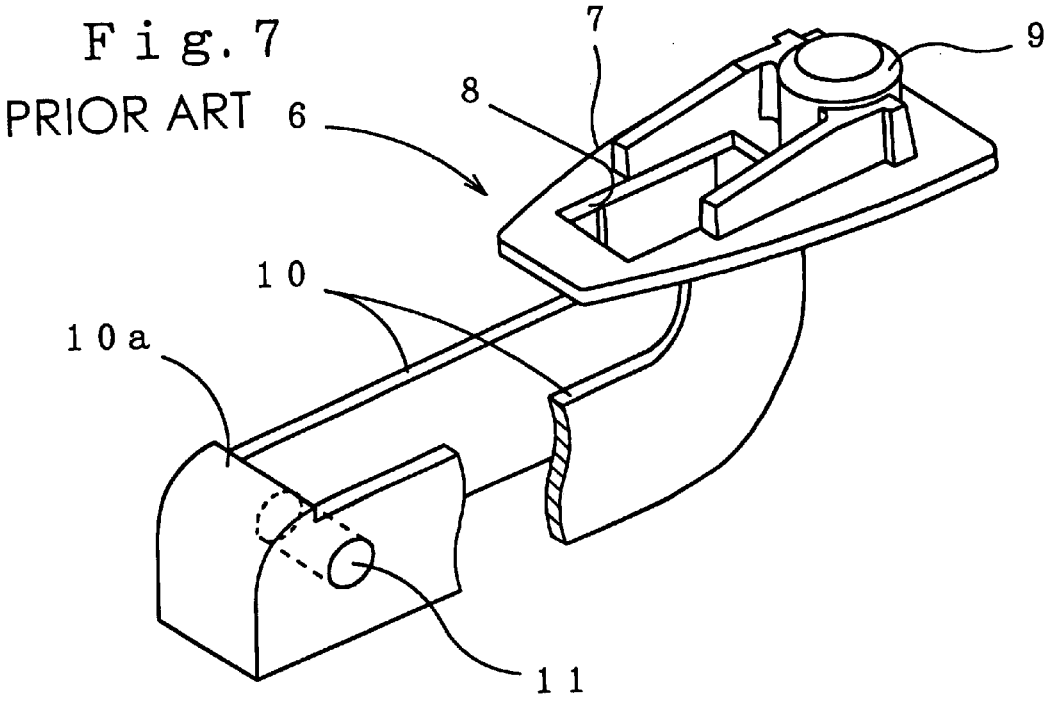
Fig. 7 PRIOR ART
FIG. 7 is a perspective view of a first base member of the prior art automobile handle device.
Figure 8:
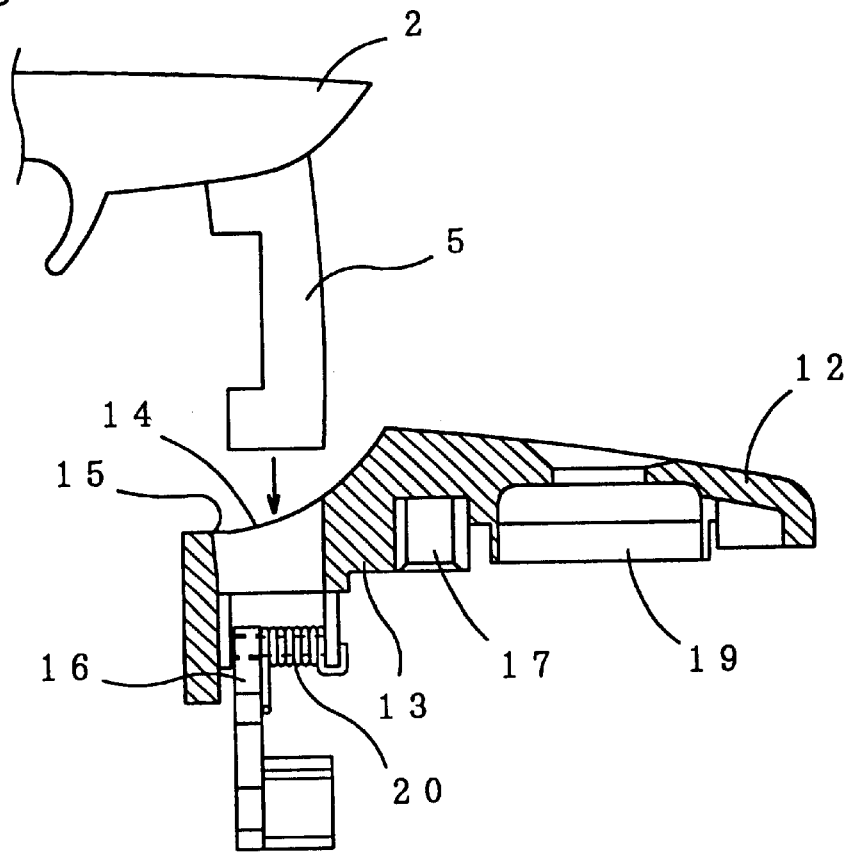
Fig. 8 PRIOR ART
FIG. 8 is a cross sectional view showing the handle member and the second base member of the prior art automobile handle device.
Figure 9A:
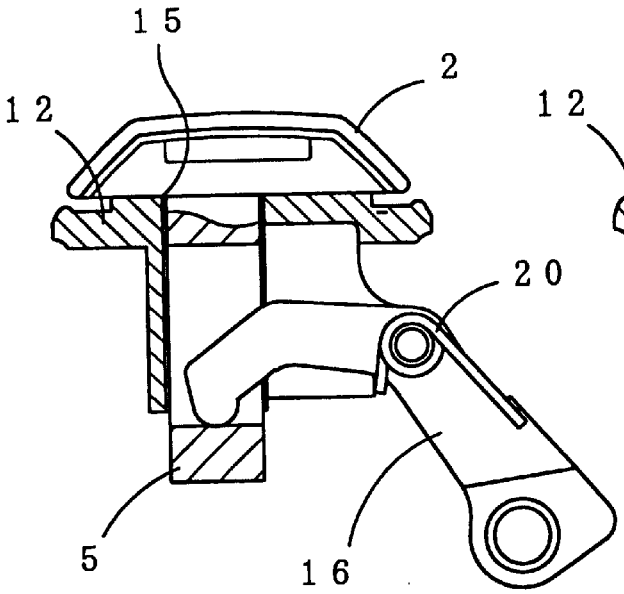
Fig. 9A PRIOR ART
FIGS. 9A and 9B are other cross sectional views showing the handle member and the second base member of the prior art automobile handle device.
Figure 9B:
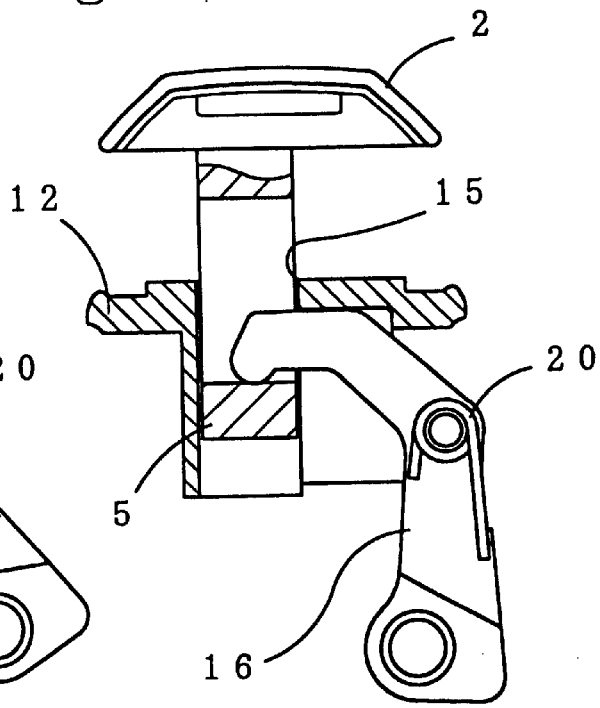
Fig. 9B PRIOR ART
Figure 10:
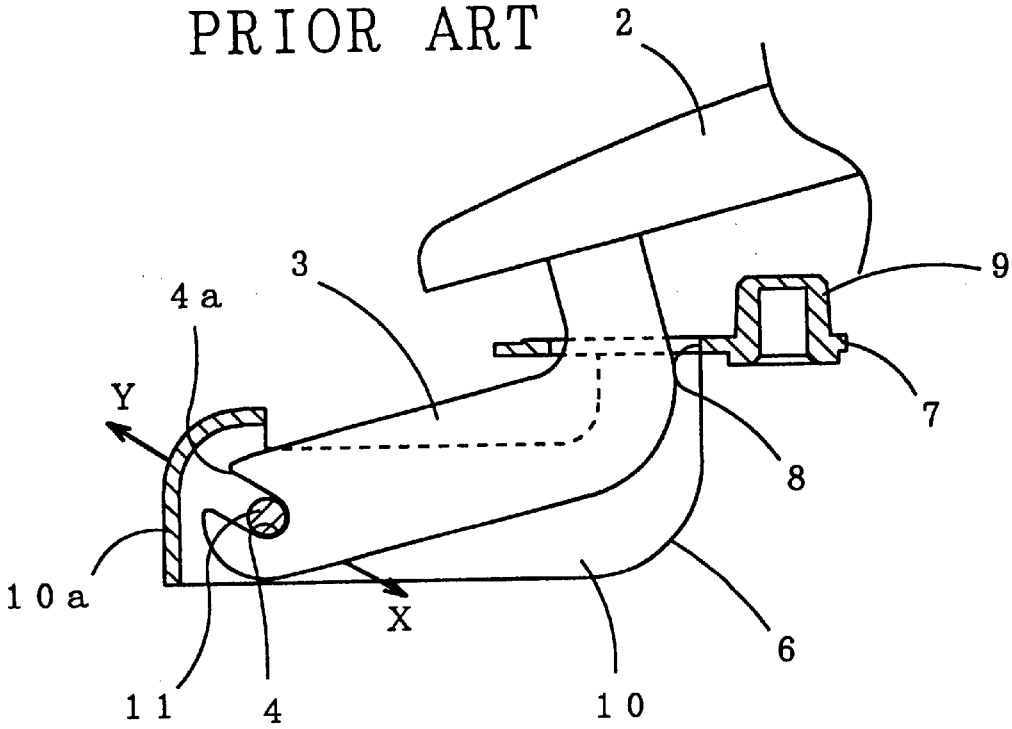
Fig. 10 PRIOR ART
FIG. 10 is a cross sectional view showing a disadvantage of the prior art automobile handle device.

In addition, as shown in FIG. 4, the frame board section 34 of the first base member 30 mounted on the handle member 2 is inserted into the inside of the cover section 42 through the first insert hole 39 of the cover member 37.

Here, the frame board section 34 of the first base member 30 is inserted in the cover section 42 along the first wall section 43, so that the coupling section 34*a* at the top edge thereof comes into contact with the second wall section 44 of the cover member 37. In this state, the first base member 30 is forcedly inserted, by which the coupling section 34*a* thereof is passed through the lower part of the second wall section 44 and protruded from the top edge of the cover section 42. As a result, the second wall section 44 of the cover member 37 is engaged and fastened between the coupling section 34*a* and the step sections 36 of the first base member 30 in an undetachable manner.

Then, the handle member 2 equipped with the first base member 30 and the second base member 12 as well as the cover member 37 is disposed on a mounting section of the door panel 1, and the fixed sections 33 and 17 of the base members 30 and 12 are fixed on the door panel 1. After that, the key cylinder 18 is mounted on the second base member 12, by which the assembling process is completed.

It will be understood that various modifications are applicable to the assembling steps of the handle device. More specifically, mounting of the second base member 12 may be carried out after the handle member 2 and the first base member 30 are assembled, and the cover member 37 is mounted on the first base member 30.

In this way, the automobile handle device of this embodiment is of a structure in which the cover member 37 is mounted so as to cover the first base member 30. Accordingly, before being mounted on the door panel 1, the lower opening of a pair of the frame board sections 34 in the first base member 30 is blocked by the cover member 37.

In this state, like the prior art, taking the handle member 2 or the first base member 30 in hand puts either of them not taken in hand in a state freely rotatable around the pivot shaft 35. However, in this embodiment, if the handle member 2 and the first base member 30 rotate in a relative manner, the arm section 3 of the handle member 2 comes into contact with one edge of the arm section insert hole 32 of the first base member 30 and the top edge of the first wall section 43 of the cover member 37, which serve as a restricting section for restricting a rotational range of the handle member 2. This prevents the pivot shaft 35 of the first base member 30 from becoming disengaged from the pivot shaft insert groove 4 of the arm section 3 in the handle member 2, so that the handle member 2 and the first member 30 are maintained in the assembled state.

As a result, an assembled unit consisting of the handle member 2, the first base member 30, the second base member 12 and the cover member 37 is not detached in the step of being conveyed to a production line of the door panel 1, which improves operability. Although in the handle device according to the prior art, detachment preventive means such as a rubber band is used for preventing the first member 30 from being detached from the handle member 2, such preventive means becomes unnecessary.

It will be understood that the automobile handle device of the present invention is not limited to the embodiment disclosed.

Figure 5:
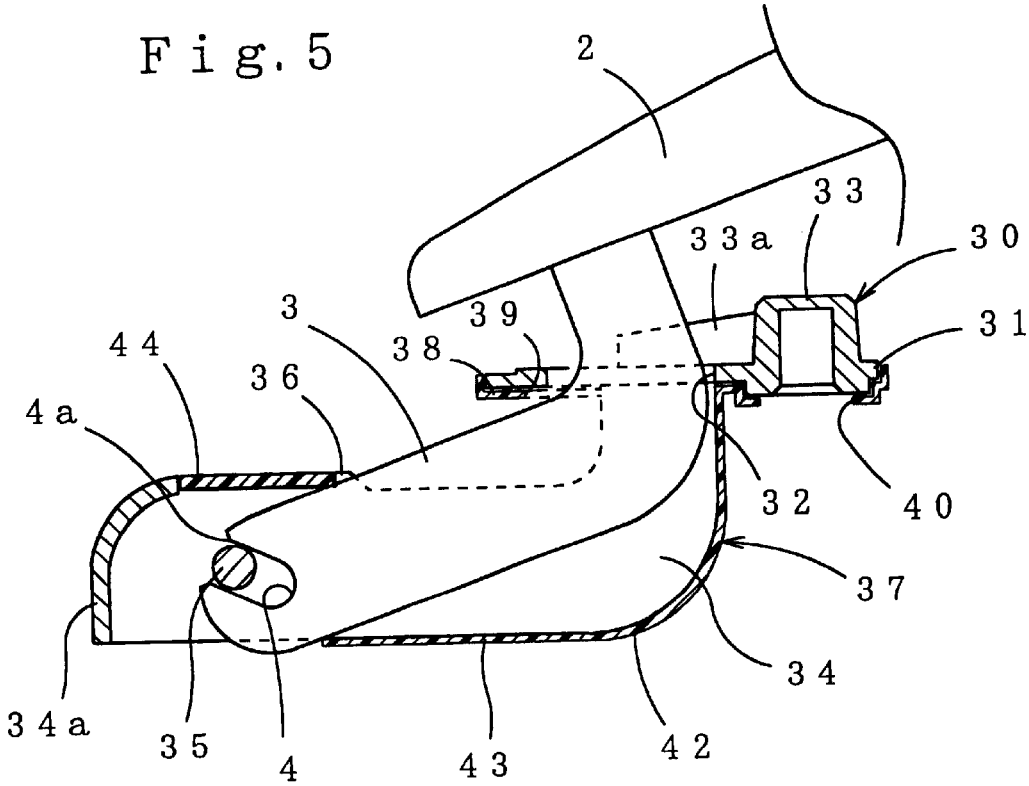
FIG. 5 is a cross sectional view showing a main part of a handle device according to the second embodiment.

For example, the restricting section for restricting the rotational range of the handle member 2 is constituted by edges of the arm section insert hole 32 in the first base member 30 and the first wall section 43 in the cover member 37. However, as shown in FIG. 5, it may be constituted by each edge of the first wall section 43 and the second wall section 44 of the cover member 37 by adjusting the dimensions thereof. The restricting section for restricting a rotational range of the handle member 2 may also be constituted by each edge of the first wall section 43 and the first insert hole 39 in the cover member 37. Such modification can provide the same functions and advantages as the embodiments described before.

As is clear from the above description, the automobile handle device of the present invention is of a structure in which a cover member having a first wall section for restricting the movement of the handle member in such a manner that the pivot shaft does not depart from the pivot shaft insert groove is mounted so as to cover a base member. Consequently, if the handle member and the base member rotate in a relative manner, detachment thereof is prevented. As a result, the detachment thereof is not generated in the step of conveyance to a production line of a door panel, which improves operability.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An automobile handle device comprising:

a handle member having an arm section protrusively provided on one end thereof and a pivot shaft insert groove with an opening section on an edge of the arm section;

a base member for fixing the handle member on an automobile door panel, made up of a fixed base board section to be fixed on the door panel, an arm section insert holes formed on the fixed base board section for inserting the arm section of the handle member, a pair of frame board sections protrusively provided in parallel from an edge of the arm section insert hole, and a pivot shaft provided across the frame board sections and received in the pivot shaft insert groove for rotatably supporting the handle member, wherein a cover member is provided which covers the base member and which has a first wall section for restricting the movement of the handle member in such manner that the pivot shaft does not depart from the axis insert groove within a rotational range of the handle member.

2. The automobile handle device as defined in claim 1, wherein a step section is provided on the pair of frame board sections in the base member, and a second wall section to be engaged with the step section is provided in the cover member.

3. The automobile handle device as defined in claim 1, wherein an edge of the arm section insert hole of the base member and the first wall section of the cover member constitute a restricting section for restricting a rotational range of the handle member.

4. The automobile handle device as defined in claim 2, wherein the first wall section and the second wall section of the cover member constitute a restricting section for restricting a rotational range of the handle member.

5. The automobile handle device as defined in claim 2, wherein an edge of the arm section insert hole of the base member and the first wall section of the cover member constitute a restricting section for restricting a rotational range of the handle member.

* * * * *